United States Patent [19]

Bertoniere et al.

[11] 4,011,613

[45] Mar. 15, 1977

[54] DURABLE-PRESS PROPERTIES IN COTTON CONTAINING FABRICS VIA POLYMERIC N-METHYLOL REAGENTS

[75] Inventors: Noelie R. Bertoniere; Stanley P. Rowland; Earl J. Roberts, all of New Orleans, La.

[73] Assignee: The United States of America as represented by the Secretary of Agriculture, Washington, D.C.

[22] Filed: Nov. 18, 1975

[21] Appl. No.: 633,067

[52] U.S. Cl. ..... 8/191; 8/181; 8/185

[51] Int. Cl.[2] ..... D06M 13/48; D06M 15/54

[58] Field of Search ..... 8/191, 185, 181

[56] References Cited

UNITED STATES PATENTS

| | | | |
|---|---|---|---|
| 2,314,968 | 3/1943 | Bestian et al. | 117/145 |
| 2,327,760 | 8/1943 | Bestian et al. | 8/116 |
| 2,677,681 | 5/1954 | Gill | 260/239 |
| 3,639,097 | 2/1972 | Bruno et al. | 8/116.2 |

*Primary Examiner*—John Kight, III
*Attorney, Agent, or Firm*—M. Howard Silverstein; Salvador J. Cangemi

[57] ABSTRACT

Durable-press properties are imparted to cotton containing fabrics with reduced losses in strength and abrasion resistance by a process which includes (1) application of a solution containing a methylolated urea modified polyethylenimine alone or in combination with other crosslinking agents and a crosslinking catalyst, (2) drying the impregnated fabrics, and (3) curing at elevated temperatures.

2 Claims, No Drawings

DURABLE-PRESS PROPERTIES IN COTTON CONTAINING FABRICS VIA POLYMERIC N-METHYLOL REAGENTS

BACKGROUND AND PRIOR ART

N-methylol compounds have been used extensively in the treatment of cotton containing fabrics for imparting durable press properties. The most extensively used class of compounds are N-methylol derivatives of amides such as dihydroxyethyleneurea, ethyleneurea, carbamates, triazones, uron and melamine which are applied in rapid pad-dry-cure processes. Fabrics modified by reaction with these amide derivatives have excellent durable press properties but retain only a small fraction of their original strength and abrasion resistance. Significant progress was made toward overcoming this drawback in a process termed wet-fixation which was first disclosed by Getchell in U.S. Pat. No. 3,138,802. Basically, the process involves padding the fabric with a combination of two reagents, a polymer forming N-methylol melamine and a crosslinking agent such as dimethyloldihydroxyethyleneurea, in the presence of a mineral acid catalyst. The wet fabric is held in a flat and wet state for as long as 24 hours at room temperature, for 15 minutes at 80° C, or for shorter periods at higher temperatures, after which the catalyst is neutralized and the unreacted reagents removed by washing. Recatalysis, drying, and curing complete the treatment. The improved strength properties observed in durable press fabrics prepared by the wet fixation process are generally attributed to a deep even penetration of the monomers into the cellulose fibers prior to fixation as part of a three dimensional network copolymer.

Recently a more rapid technique for fixing the reagent has been disclosed by Hollies in U.S. Pat. No. 3,709,657. In this process the wet impregnated fabrics are held under non-evaporative, hot conditions, (100°–140° C) for short times (10–90 sec.). This improved process nevertheless involves an additional fixation and washing step which is not desirable in industrial practice.

The prior art in the field of durable press thus suffers two distinct disadvantages. The pad-dry-cure process employing conventional N-methylolamides is satisfactory for mill operation and yields fabrics with high levels of resilience but the treated fabrics have significantly reduced strength and abrasion resistance. The wet fixation technique gives products with good resilience and strength properties but the treatment involves two stages which is undesirable from a processing point of view.

OBJECTS OF THE INVENTION

It is therefore the object of this invention to provide a process for imparting high levels of resilience to cotton containing fabrics without simultaneously effecting undue decreases in strength and abrasion resistance. Another object is the provision of a process for imparting good durable press and strength properties without the necessity for holding the fabric in a wet state while polymerization occurs prior to drying and curing.

DESCRIPTION OF THE PREFERRED EMBODIMENTS

Our invention is based upon the unexpected discovery that certain N-methylol derivatives of preformed polymers can be applied to cotton containing fabrics in a pad-dry-cure process to yield a fabric with high levels of resilience but without excessive losses in strength and abrasion resistance. These polymers evidently evenly penetrate the cellulosic fibers, contrary to what would be predicted on the basis of current theory.

Agents which are the subject of this invention are methylolated urea-modified polyethylenimines (U-PEI). These agents are prepared from polyamines or polyethylenimines in which the degree of polymerization ranges from 3 to 2500. Although there may be some differences among specific compositions, the ratio of tertiary amine groups to primary amine groups is approximately 0.25 and for the compositions of higher degree of polymerization the ratio of primary/-secondary/tertiary amine groups is generally 1/2/1. Urea modification occurs at primary and secondary amine groups; for the purpose of this invention, reactions to prepare the U-PEI employ ratios of urea of primary-plus-secondary amine groups of 0.85–1.5. A ratio near unity is generally preferred. The amide groups bearing protons are methylolated with formaldehyde with or without addition of base to adjust pH. Excesses of up to 25% of either urea or formaldehyde in solutions of the reagent are tolerated. The extent of urea modification is restricted to a fractional lower limit of 0.85 (preferably 1.0) because of the high reactivity between formaldehyde and the unmodified nitrogeneous polymers (polyethylenimines) which effects rapid gelation of the reagent and because of the tendency of the unmodified polymers to yellow upon exposure to high temperatures in the curing step.

Although several preparative techniques are possible the reagents employed in this invention were prepared by refluxing a water solution of a polyethylenimine with urea. The urea modified polyethylenimine (U-PEI) was subsequently methylolated by room temperature reaction with formaldehyde.

These reagents may be applied either alone or in combination with another type of N-methylol crosslinking agent of which dimethyloldihydroxyethyleneurea is an example. The polymeric reagent should comprise no less than 0.5% of the total resin solids. In our invention we employ an N-methylol resin concentration from 2–20% of the total weight of the pad bath although the exact concentration is not critical.

As for the selection of a catalyst in this invention, practically all of those normally employed to develop durable press properties are suitable but $Al_2(OH)_2Cl.2H_2O$ and $MgCl_2.6H_2O$ are preferred. The amount of catalyst is not critical and can be varied from 0.1 to 10% based on the weight of the pad bath. However, a fractional concentration of 0.2–0.4 of the weight of the resins is preferred. In addition to crosslinking agents and catalysts, other additives, such as wetting agents and softeners, may be included in the treatment.

As compared to the prior art, our invention possesses an extremely important advantage. There is no need to hold the impregnated fabric for any extended period of time in the wet state prior to drying so as to permit the reaction to occur. The fabric may or may not be dried at low temperatures (50°–100° C) immediately after padding; however, we prefer 60°–70° C. The time of drying depends upon the weight of the fabric employed. For example, a 8 oz/yd$^2$ requires approximately 10 minutes at 70° C. The dry fabric is cured at temperatures between 150° and 180° C for 2 to 8 minutes, even longer times being employed for undried fabrics. Moderate conditions such as 160° C for approximately 3 minutes are preferred in the laboratory oven. Following the curing step, the fabrics may be thoroughly rinsed and dried.

Inasmuch as the crosslinking occurs with cellulose, the invention is applicable to cellulose containing fabrics. These include not only cotton and rayon but also blends of this natural polymer with synthetic fibers such as polyester, nylon, and acrylics. Blends may contain as little as 25% cellulose. The only criterion as to the synthetic fiber composition in that it not be affected adversely by the treatment.

The following examples illustrate but do not limit the scope of this invention. Add-ons were calculated from the percent nitrogen incorporated. Durable press ratings were determined by the AATCC test Method No. 124. Conditioned and wet wrinkle recovery angles were measured with the Monsanto tester, ASTM D-1295-67. Results are expressed in degrees (warp + fill). Breaking strength and elongation and Stoll flex abrasion resistance were measured in the fill direction and are expressed as percent of the original fabric.

EXAMPLE 1

A cotton twill was treated with a methylolated urea modified polyethylenimine ranging in degree of polymerization from 3.5 to 10.5 at the 15% solids level. $Al_2(OH)_5Cl.2H_2O$ (3%) was employed as the crosslinking catalyst. The pad bath also contained a polyethylene softener and a wetting agent. After dipping and squeezing through rolls the fabric was dried (70° C, 10 min.) and cured (160° C, 3 min). The treated fabric had an add-on of 8.8% and contained 2.4% nitrogen and 2.0% formaldehyde. It had good resilience (conditioned and wet wrinkle recovery angles 294° and 278°, respectively) and high retention of strength (tearing 90%, breaking 56%) and abrasion resistance (Stoll flex 135%).

EXAMPLE 2

A 15% solids mixture if methylolated urea modified polyethylenimine ranging in degree of polymerization from 10.5 to 17.5 with dimethyloldihydroxyethyleneurea (1:1, w:w) was padded onto a cotton twill (2 dips, 2 nips). The treating solution contained a polyethylene softener and wetting agent as well as 3% $Al_2(OH)_5Cl.2H_2O$. The fabric was cured at 160° C for 3 minutes after having been dried at 70° C for 10 minutes. The results were: add-on 8.1%, nitrogen 1.9%, formaldehyde 1.9%, conditioned wrinkle recovery angle 295°, wet wrinkle recovery angle 259°. Retention of Stoll flex abrasion resistance was 47%; other retentions were: tearing strength 81%, breaking strength 45%, and elongation 62%.

EXAMPLE 3

Alternatively $MgCl_2.6H_2O$ was employed at the 4% level as the crosslinking catalyst in a pad bath which contained 10% methylolated urea modified polyethylenimine, DP = 10.5 to 17.5, and also a wetting agent and polyethylene softener. Cotton twill samples were dipped into the solution and squeezed through rolls. They were dried in a forced draft oven at 70° C for 10 minutes and cured in a similar oven at 160° C for 3 minutes. The treated fabrics had an add-on of 5.7%. The conditioned and wet wrinkle recovery angles achieved were 256° and 240°, respectively. These samples retained 55% of their original breaking strength, 112% of their tearing strength, and 241% of their abrasion resistance (Stoll flex). The above experiment was repeated using a urea modified polyethylenimine ranging in degree of polymerization from 1100 to 2400 both alone and in combination with dimethylolethyleneurea (1:4, w:w in the latter case). A 65% cotton/35% polyester sheeting was treated. The drying temperature was reduced to 60° and samples were cured both 160° for 4 minutes and 170° for 3 minutes. Similar results were obtained.

EXAMPLE 4

A urea modified polyethylenimine ranging in degree of polymerization from 3.5 to 10.5 was used in combination with several other reagents. At a total solids concentration of 10% it was combined with dimethyloldihydroxyethyleneurea (1:1, w:w) in a treating solution containing 4% $MgCl_2.6H_2O$ along with a softener and wetting agent. A cotton twill treated with this solution (dipped, squeezed through rolls, dried at 70° C for 10 minutes and cured at 160° C for 3 minutes) had an add-on of 5.5%. It had high resilience (durable press rating 3.8, conditioned wrinkle recovery angle 290°, wet wrinkle recovery angle 261°) and good strength retention (breaking strength 43%, tearing strength 86%) as well as abrasion resistance (76%, Stoll flex). On an 85% cotton/15% polyester sheeting this modified polyethylenimine was employed in combination with bis(methoxymethyl uron) (0.5:9.5 w:w add-on 5.8%, durable press rating 4.2) and (3.7 w:w, add-on 6.2, durable press rating 3.9); with a methylated methylolated melamine (0.5:9.5 w:w, add-on 6.3%, durable press rating 4.1) and (3.7 w:w, add-on 6.9%, durable press rating 3.9); with a methylated urea formaldehyde (0.5:9.5 w:w, add-on 7.9%, durable press rating 4.0) and (3:7 w:w, add-on 8.4%, durable press rating 3.8); and with dimethylol methyl carbamate (0.5:9.5 w:w, add-on 4.8%, durable press rating 4.2) and (3:7 w:w, add-on 5.9%, durable press rating 4.0).

EXAMPLE 5

A treating solution was prepared containing 15% urea modified triethylenetetramine, 3% $Al_2(OH)_5Cl.2H_2O$, 2% polyethylene softener and 0.1% wetting agent. Samples of cotton twill were dipped into the solution and squeezed through rolls and then subjected to a repeat dipping and squeezing. The fabric was dried at 70° for 10 minutes and then cured for 3 minutes at 160°. The treated fabric had an add-on of 7.6%. It had a durable press rating of 4.2, a conditioned wrinkle recovery angle of 265° and a wet wrinkle recovery angle of 207°. It retained 18% of its original Stoll flex abrasion resistance, 49% of its tearing strength and 56% of its breaking strength. Similar results were obtained with a urea modified tetraethylenepentaamine.

We claim:

1. A process for imparting durable-press properties to cotton containing fabrics comprising:
   a. impregnating a cotton containing fabric with an aqueous solution containing methylolated urea modified polyethylenimine, and an acid catalyst;
   b. drying the impregnated fabric from (a); and
   c. curing the dried fabric from (b).

2. A process for imparting durable-press properties to cotton containing fabrics comprising:
   a. impregnating a cotton containing fabric with aqueous solution containing a methylolated urea modified polyethylenimine, an N-methylol crosslinking agent, and an acid catalyst;
   b. drying the impregnated fabric from (a); and
   c. curing the dried fabric from (b).

* * * * *